US005495960A

United States Patent [19]

Lam et al.

[11] Patent Number: 5,495,960

[45] Date of Patent: Mar. 5, 1996

[54] MULTI-TIER STORAGE APPARATUS

[76] Inventors: Peter W. Lam; Stacey H. Lam, both of P.O. Box #251953, Los Angeles, Calif. 90025

[21] Appl. No.: 383,800

[22] Filed: Feb. 6, 1995

[51] Int. Cl.[6] ..... B65D 85/00

[52] U.S. Cl. ..... 220/485; 220/23.83; 206/513

[58] Field of Search ..... 220/485, 23.83, 220/23.86; 206/511, 513

[56] References Cited

U.S. PATENT DOCUMENTS

| | | | |
|---|---|---|---|
| 2,944,694 | 7/1960 | Kinsey | 220/23.83 X |
| 3,037,658 | 6/1962 | Schray et al. | 220/23.83 X |
| 3,100,582 | 8/1963 | Lockwood | 206/513 X |
| 3,366,264 | 1/1968 | Panknin | 206/513 X |
| 3,704,791 | 12/1972 | Young, Jr. | 220/485 X |
| 4,015,712 | 4/1977 | Wadensten | 206/513 X |
| 5,441,707 | 8/1995 | Lewis et al. | 220/23.86 X |

*Primary Examiner*—Steven M. Pollard
*Attorney, Agent, or Firm*—John S. Christopher

[57] ABSTRACT

A multi-tier storage apparatus employed in a sales environment for storing and displaying fragile merchandise subject to damage during earthquakes and other natural disasters. The invention includes a first container having a plurality of upright walls and a bottom surface each including a mesh construction which is utilized for storing and displaying merchandise. A horizontal projection extends into the first container from the upright walls. A plurality of second containers are mounted on the horizontal projection for storing and displaying merchandise. Each of the second containers includes a mesh construction and is movable relative to other of the second containers and to the first container along the horizontal projection for accessing the first container. In a preferred embodiment, a first or lower container is formed in a mesh construction and preferably in a rectangular shape. Formed along the upright walls of the two length dimensions of the lower container is a pair of horizontal projections or ledges. A pair of second or upper containers each having a mesh construction similar to the lower container and each having a plurality of wheels are mounted on the horizontal projections. Each of the upper containers is movable with respect to the other upper container and to the lower container for providing access to the lower container. Furthermore, the lower container includes a lockable hinged door for alternative access thereto.

18 Claims, 3 Drawing Sheets

MULTI-TIER STORAGE APPARATUS

BACKGROUND OF THE INVENTION

1. Field of the Invention

The present invention relates to mechanical storage apparatuses. More specifically, the present invention relates to methods and apparatus for a multi-tier storage apparatus that provides a spacious and stable storage environment for breakable merchandise that is stored or displayed geographical locations having earthquake fault activity.

2. Description of the Related Art

Earthquake faults exist in many locations in the United States and throughout the world. Although the location of many of these faults are known, it is statistically difficult to predict earthquake fault activity since seismology is an inexact science. Consequently, since we are unable to accurately predict or control such activity, much damage often occurs during an earthquake event.

Typically, retail businesses suffer heavy losses during earthquake activity. In particular, supermarkets, restaurants, glassware and porcelainware dealers and others who display and sell fragile merchandise suffer the greatest hardship and financial loss. Much of the loss results from the business owners failure to adequately stabilize and protect the fragile merchandise. For example, fragile and perishable merchandise offered for sale in a supermarket is often merely stacked on a conventional shelf without the benefit of any retaining device. Additionally, merchandise is often arranged on an unstable display platform located in the passageways of the supermarket. The display platforms are normally comprised of a pallet to serve as a base and an upright cardboard construction. Under normal conditions, the stacked merchandise is generally safe. However, during an earthquake event when the buildings and particularly conventional shelves are subject to unusual stresses, the stacked merchandise can easily be thrown to the floor. The merchandise is then often damaged or the containers are broken resulting in exposure and spoilage of the contents therein.

Similar conditions also exist in restaurants. In particular, breakable items such as dishes, cooking utensils and the like in food preparation areas, and dining table articles, condiment containers and the like when temporarily stored in collection areas are subject to earthquake forces and are often damaged when thrown to the floor. Many others who engage in the retail trade of breakable items such as glassware, porcelainware, pewter and the like also often suffer much damage during an earthquake event.

The conventional shelves and racks normally employed to display these items offer little protection to the merchandise during an earthquake event. Not only is the merchandise subject to being thrown to the floor but breakable items, such as bottles, can be easily damaged merely by tipping over or by contact with other similar merchandise. Furthermore, once the merchandise has been positioned onto conventional shelves, it is time consuming and tedious to remove the merchandise for the purpose of cleaning the shelves or for simply relocating the merchandise.

Thus, there is a need in the art for an improvement in the storage of breakable merchandise that is stored or displayed in geographical locations having earthquake fault activity such as supermarkets, restaurants, and retail outlets for glassware, porcelainware, pewter and other breakable items. The improved storage device should comprise a storage apparatus that provides greater protection of the merchandise during an earthquake event than does conventional shelves and racks, provides generous storage space for displaying the merchandise, is conveniently accessible by customers, can easily be transported from one location to another inside or outside the retail outlet, and provides improved stability in that a design utilizing a lower center of gravity is employed.

SUMMARY OF THE INVENTION

The need in the art is addressed by the multi-tier storage apparatus of the present invention. The invention is typically employed in a sales environment for storing and displaying fragile merchandise subject to damage during earthquakes and other natural disasters. The multi-tier storage apparatus comprises a first container having a plurality of upright walls and a bottom surface each including a mesh construction which is utilized for storing and displaying merchandise. A horizontal projection extends into the first container from the upright walls. A plurality of second containers are mounted on the horizontal projection for storing and displaying merchandise. Each of the second containers includes a mesh construction and is movable relative to other of the second containers and to the first container along the horizontal projection for accessing the first container.

In a preferred embodiment, a first or lower container is formed from metal or plastic materials or a combination thereof in a mesh construction and preferably in a rectangular shape. Formed along the upright walls of the two length dimensions of the lower container is a pair of horizontal projections or ledges. A pair of second or upper containers each having a mesh construction similar to the lower container and each having a plurality of wheels are mounted on the horizontal projections. Each of the upper containers is movable with respect to the other upper container and to the lower container for providing access to the lower container. Furthermore, the lower container includes a lockable hinged door for alternative access thereto.

DESCRIPTION OF THE INVENTION

Figure 1:
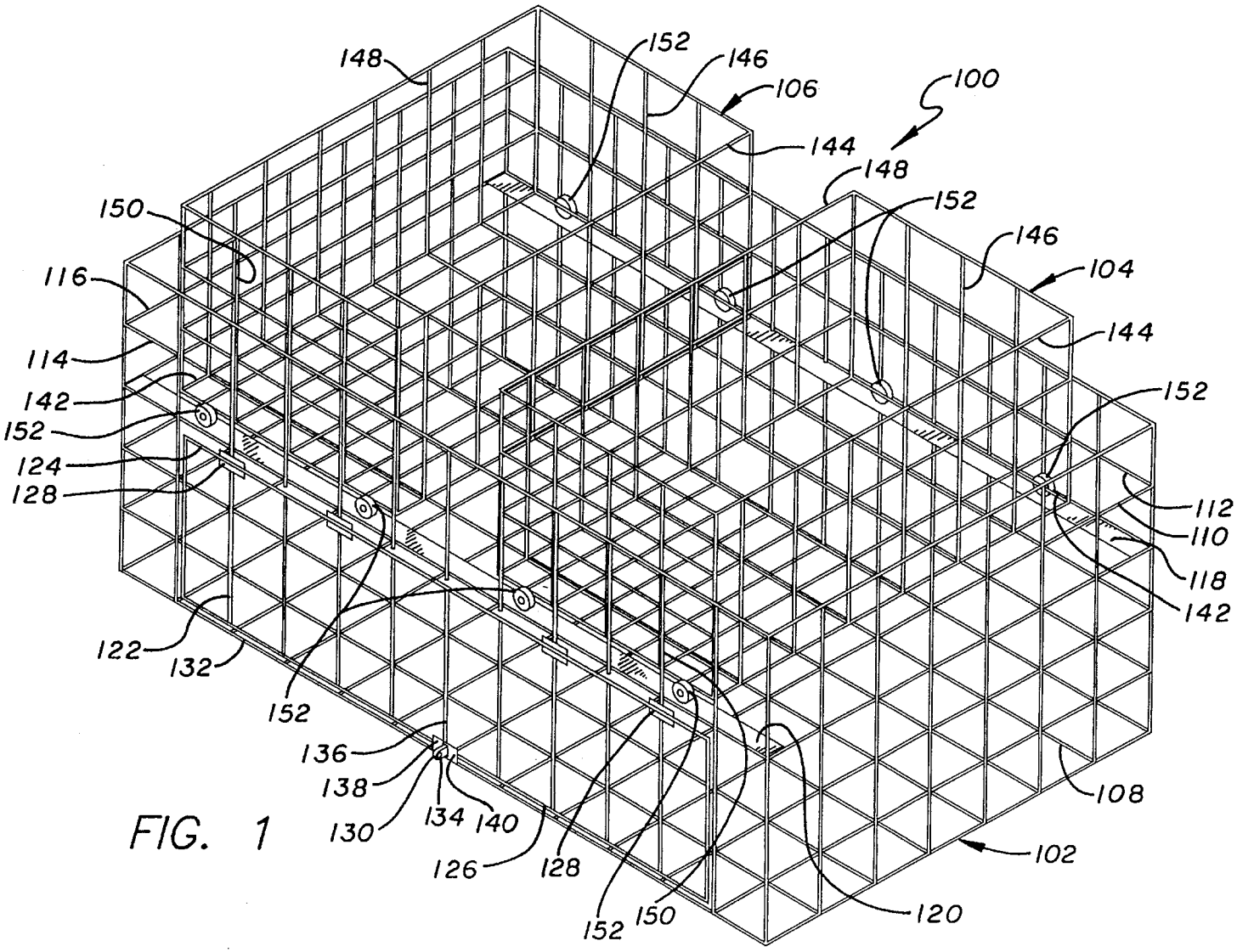
FIG. 1. is perspective view of the multi-tier storage apparatus of the present invention showing two adjacent upper containers mounted on and movable with respect to a lower container.

The present invention is a multi-tier storage apparatus 100 as shown in FIG. 1. The multi-tier storage apparatus 100 is typically employed in a sales environment for storing and displaying fragile merchandise subject to damage during earthquakes and other natural disasters. The multi-tier storage apparatus 100 shown in FIG. 1 includes a lower container 102 and a pair of first and second upper containers 104 and 106, respectively. The lower container 102 and the two upper containers 104 and 106 are more clearly shown in the exploded view of FIG.2.

Figure 2:
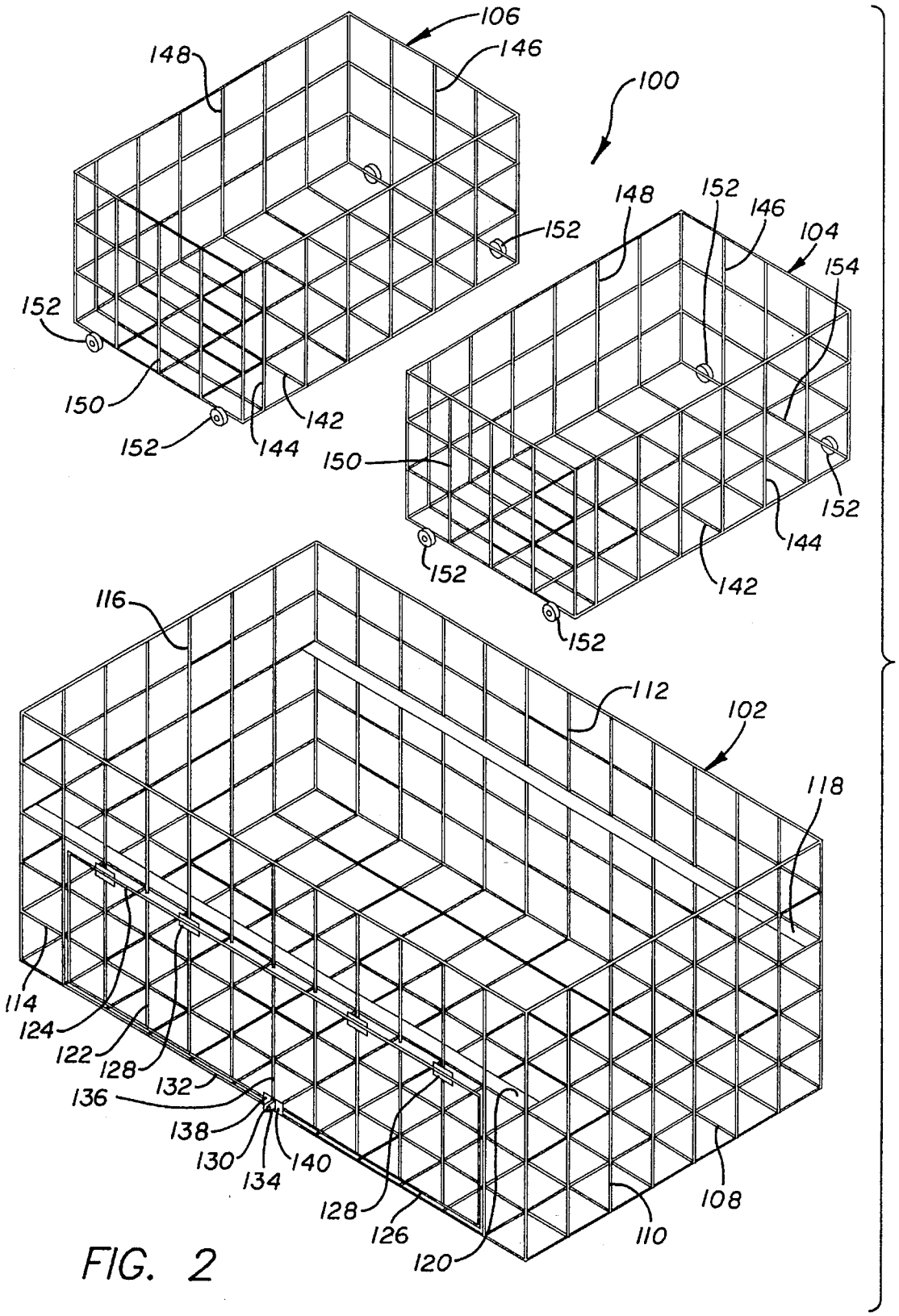
FIG. 2. an exploded view of the multi-tier storage apparatus of FIG. 1 showing the two upper containers separated from the lower container.

The lower container 102 includes a bottom surface 108 interfacing with a plurality of four upright sidewalls 110, 112, 114 and 116, respectively, to form a rectangular, open top container structure as best shown in FIG. 2. The upright sidewalls 110 and 116 form the width dimensions while the upright sidewalls 112 and 114 form the length dimensions of the rectangular shaped lower container 102. The bottom surface 108 and each of the sidewalls 110, 112, 114 and 116 are formed of a mesh construction. The mesh construction is preferably comprised of metal such as heavy duty aluminum or steel wire mesh but may also be comprised of high strength plastic or a combination of wire and high strength plastic mesh as is known in the art. The high strength plastic mesh construction can be comprised of materials such as, for example, acrylic resin or thermoplastic or thermosetting polymers or copolymers of acrylic acid and the like.

The gauge of the wire or the strength of the plastic utilized in the mesh construction of the lower container 102 is selected to be adequate for anticipated loads. Furthermore, the size of the mesh, e.g., the dimensions between the elements of wire or plastic used to form the mesh, is selected to be small enough to prevent articles of merchandise from escaping through the mesh but large enough to provide a clear view of the merchandise stored and displayed therein. The mesh construction is welded so as to ensure that the lower container 102 exhibits an integral unitary structure capable of supporting heavy loads such as those encountered in supermarkets and other sales outlets.

Formed along the inside of the upright walls 112 and 114 of the two length dimensions of the lower container 102 is a pair of horizontal projections or ledges 118 and 120, respectively. The projections 118 and 120 are fashioned from material corresponding to that of the lower container 102. Thus, if the sidewalls 112 and 114 of the lower container 102 are comprised of heavy duty aluminum wire mesh, then the horizontal projections 118 and 120 are preferably metal and can be welded to the heavy duty aluminum wire mesh. Likewise, if the sidewalls 112 and 114 of the lower container 102 are comprised of high strength plastic mesh, then the horizontal projections are preferably plastic and can be molded to the high strength plastic mesh.

Each of the horizontal projections 118 and 120 serve to support the first and second upper containers 104 and 106, respectively, as is clearly shown in FIG. 1. Thus, the mounting position of the horizontal projections 118 and 120 along the interior vertical dimension of the upright sidewalls 112 and 114 determines the depth that the upper containers 104 and 106 seat within the lower container 102. Furthermore, the vertical mounting position of the projections 118 and 120 sets a limit on the height of the merchandise that is stored and displayed in the lower container 102. The maximum height of any merchandise stored and displayed within the lower container 102 must be less than the vertical dimension at which the interior horizontal projections 118 and 120 are affixed to the sidewalls 112 and 114, respectively.

The lower container 102 is also fitted with an access door 122 as shown in FIGS. 1 and 2. The access door 122 is located within the length dimension of the upright sidewall 114 and is comprised of the same mesh construction as that of the lower container 102. The length of the access door 122 extends almost the entire length dimension of sidewall 114. However, the height dimension of the access door 122 is selected so that the top edge 124 is slightly lower than that point at which the horizontal projection 120 is attached to the interior surface of sidewall 114. Furthermore, the height dimension is limited so that the bottom edge 126 of the access door 122 terminates just above the mesh structure forming the bottom surface 108 of the lower container 102.

The upper height limitation of the top edge 124 of the access door 122 provides access to that portion of the lower container 102 that is beneath the first and second upper containers 104 and 106, respectively. Likewise, the lower height limitation of the bottom edge 126 enables the access door 122 to neatly fit into the frame structure of the upright sidewall 114 surrounding the access door 122. The access door 122 can be affixed to the upright sidewall 114 by a plurality of hinged devices 128 as is known in the art. Typically, the top portion of each hinged device 128 is attached to the upright sidewall 114 as by welding or clamping as is known in the art. Likewise, the lower portion of each hinged device 128 can be attached to the top edge 124 of the access door 122 also by welding or clamping. Thereafter, when a pulling force is applied to the bottom edge 126, the entire access door 122 rotates about the plurality of hinged devices 128.

The access door 122 is also lockable as will now be described. An extension shaft 130 is formed or attached to one of the mesh construction elements 132 of the bottom surface 108 in the lower container 102 as shown in FIGS. 1 and 2. The extension shaft 130 can be attached to the mesh element 132 in any manner known in the art such as by welding or clamping. The extension shaft 130 includes a penetration 134 which passes through the vertical plane thereof. The penetration 134 includes a diameter sufficiently large enough to receive a locking mechanism (not shown).

Attached to one of the vertical mesh construction elements 136 of the upright sidewall 114 is a lock plate 138 having a penetration 140 formed therein. The lock plate 138 can be attached to the vertical mesh element 136 in any manner known in the art such as by welding or clamping. As is shown in FIGS. 1 and 2, the extension shaft 130 is aligned with and protrudes through the penetration 140 formed in the lock plate 138. Thus, it is understood that the shape of the extension shaft 130 necessarily includes an arc or angle (not shown) that enables the extension shaft 130 to be attached to the mesh element 132 and to be in proper alignment with the penetration 140 formed in the lock plate 138. Thus, a pulling force applied to the bottom edge 126, not only enables the access door 122 to rotate about the hinged devices 128 but also disengages the lock plate 138 from the extension shaft 130. When the access door 122 is rotated back into the closed position, the extension shaft 130 passes through the penetration 140 reengaging the lock plate 138 so that the access door 122 can be locked with a locking mechanism (not shown). The access door 122 is normally locked and only opened by sales personnel to install or remove merchandise.

The first and second upper containers 104 and 106, respectively, are each shown in FIGS. 1 and 2. In the preferred embodiment, each of the first and second upper containers 104 and 106 are identical in construction, shape and operation. Therefore, upper container 104 will be described in detail wherein the description and corresponding identifying numerals placed upon the drawing figures will apply equally to upper container 106. It should be noted that the construction and shape of the upper containers 104 and 106 need not be identical. For example, it is within the spirit of the invention that the height and width dimensions of the upper containers 104 and 106 could vary from one another. Furthermore, the means by which the upper containers 104 and 106 move along the horizontal projections 118 and 120 could also vary from one another. Additionally, it is foreseen that one of the upper containers 104 or 106 could include a lid or cover while the other does not. With these thoughts in mind, upper container 104 will now be described.

Upper container 104 is comprised of a mesh construction similar to that of the lower container 102 previously described herein. In particular, the upper container 104 includes a bottom surface 142 interfacing with a plurality of four upright sidewalls 144, 146, 148 and 150, respectively, to form a rectangular, open top container structure as best shown in FIG. 2.

The upright sidewalls 146 and 150 form the width dimensions while the upright sidewalls 144 and 148 form the length dimensions of the rectangular shaped upper container 104. The bottom surface 142 and each of the sidewalls 144, 146, 148 and 150 are formed of a mesh construction. As with the lower container 102, the mesh construction is preferably a heavy duty aluminum or steel wire mesh but may also be comprised of high strength plastic or a combination of wire and high strength plastic mesh as is known in the art.

The gauge of the wire or the strength of the plastic utilized in the mesh construction of the upper container 104 is selected to be adequate for anticipated loads. Furthermore, the size of the mesh, e.g., the dimensions between the elements of wire or plastic used to form the mesh, is selected to be small enough to prevent articles of merchandise from escaping through the mesh but large enough to provide a clear view of the merchandise stored and displayed therein. The mesh construction is welded so as to ensure that the upper container 104 exhibits an integral unitary structure capable of supporting heavy loads such as those encountered in supermarkets and other sales outlets.

Figure 3:
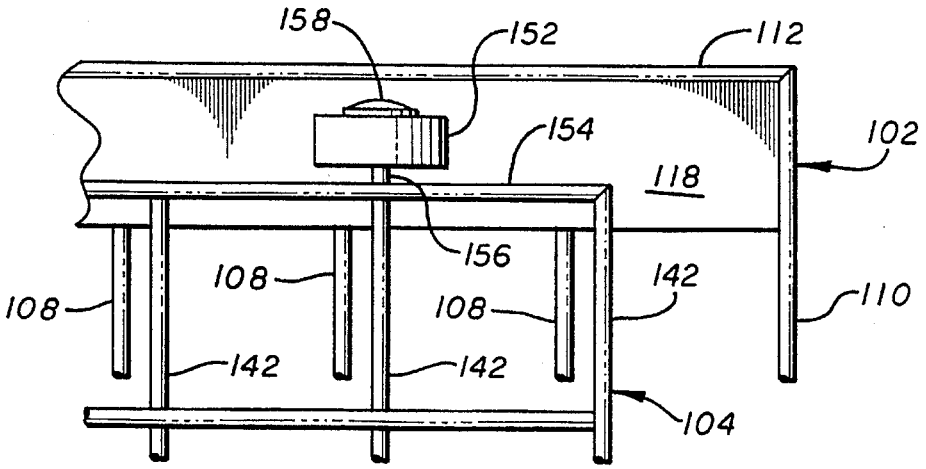
FIG. 3. is a top planar view showing the detail of one of a plurality of wheels attached to each of the two upper containers and mounted on a ledge formed within the lower container to enable each of the two upper containers to move relative to the other upper container and to the lower container.

Each of the upper containers 104 and 106 includes a plurality of wheels 152 as is shown in FIGS. 1 and 2. Each of the wheels 152 are identical and are attached adjacent to the bottom surface 142 of the upper containers 104 and 106. The detail drawing shown in FIG. 3 illustrates one of many means suitable for attaching each of the wheels 152 adjacent to the bottom surface 142 of the upper container 104. Included within the detail drawing of FIG. 3 is a portion of the lower container 102 showing the outer boundaries of the upright sidewalls 110 and 112, respectively, and the intersection therebetween. Welded or molded to the interior surfaces of the two upright sidewalls 110 and 112 is the horizontal projection 118. Also shown extending outward from underneath the horizontal projection 118 is a portion of the mesh construction of the bottom surface 108 of the lower container 102.

Also shown in FIG. 3 is a portion of the mesh construction of the bottom surface 142 of the upper container 104. Part of the mesh construction of the bottom surface 142 is a mesh structural element 154 which is located at the intersection of the upright sidewall 146 and the bottom surface 142 of the upper container 104. The location of mesh structural element 154 can be best understood by referring to the upper container 104 as shown in FIG. 2.

Extending outward and away from the mesh structural element 154 is an axle 156 to which the wheel 152 is connected. Each wheel 152 includes a center hub 158 which is in physical communication with the axle 156 by any of several methods known in the art. The wheel 152 is free to rotate about the axle 156 at the hub 158. The axle 156 can be comprised of a metal shaft welded to the heavy duty aluminum wire mesh of the upper container 104. In the case of a plastic mesh upper container 104, the axle 156 can be comprised of the high strength plastic previously described. The wheels 152 can be comprised of nylon and have a plastic or rubber surface.

The plurality of wheels 152 connected to each of the upper containers 104 and 106 transfer the weight of the upper containers 104 and 106 and the contents thereof to the horizontal projections 118 and 120. Thus, the horizontal projections 118 and 120 must be securely fastened as by welding or molding to the corresponding upright sidewalls 112 and 114, respectively. Furthermore, the horizontal projections 118 and 120 must be sufficiently wide to enable the plurality of wheels 152 to track the projections 118 and 120. The wheels 152 enable the upper containers 104 and 106 to be manually moved along the horizontal projections 118 and 120. The upper containers 104 and 106 can be moved with respect to one another and with respect to the lower container 102 in order to obtain access to merchandise stored and/or displayed in the lower container 102. Furthermore, both of the upper containers 104 and 106 can be removed from, the multi-tier storage apparatus 100 to provide uninhibited access to the lower container 102. Merchandise stored and displayed in the upper containers 104 and 106 is, of course, immediately accessible.

Figure 4:
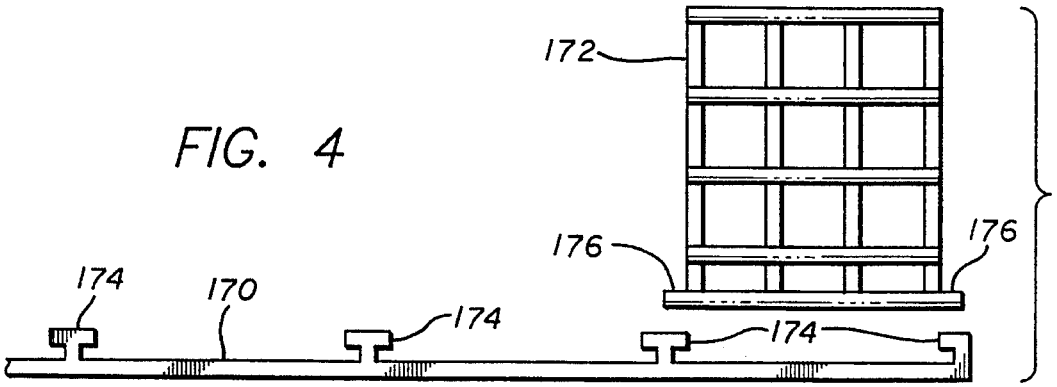
FIG. 4. is a front elevational view showing a platform mounted on the bottom surface of the lower container of the multi-tier storage apparatus of FIG. 1 and a subcontainer mounted on the platform.
Figure 5:
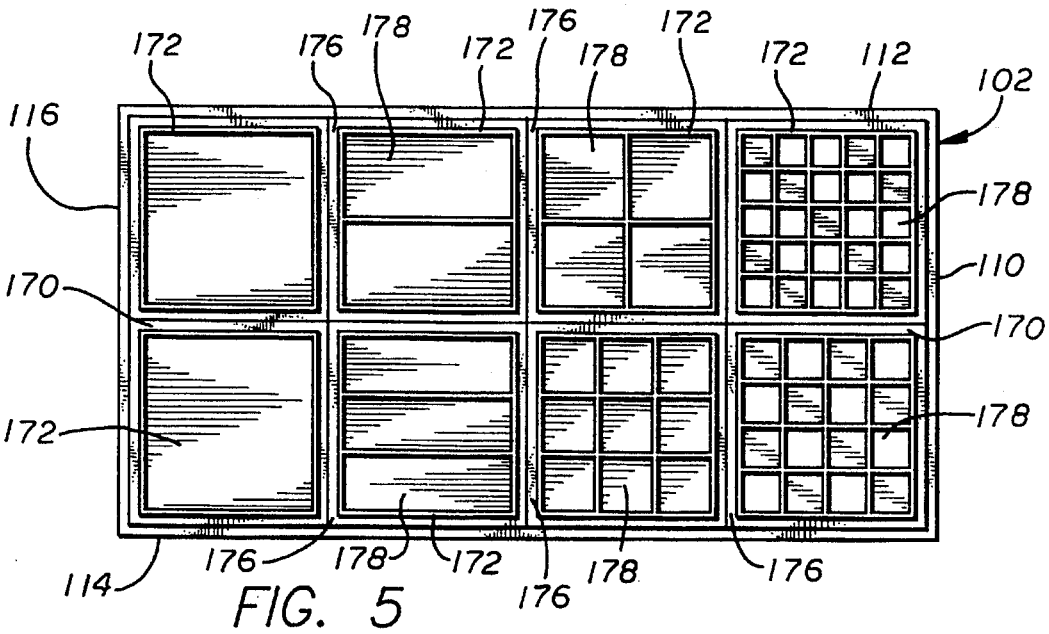
FIG. 5. is a top planar view of a plurality of subcontainers each having various storage configurations and each mounted upon the platform of the multi-tier storage apparatus shown in FIG. 4.

A storage platform 170 in combination with a plurality of subcontainers 172 is provided as an optional feature for use with the multi-tier storage apparatus 100 as is shown in FIGS. 4 and 5. The platform 170 shown in FIG. 4 is designed to be seated on top of the bottom surface 108 of the lower container 102. The platform 170 can be comprised of metal of a sufficient gauge to support weight loads typically encountered in supermarkets. In the alternative, the platform 170 can also be comprised of high strength plastic when utilized with a lower container 102 also fashioned from high strength plastic.

The platform 170 includes a plurality of upward extending T-bars or runners 174 for supporting a plurality of the subcontainers 172 as is shown in FIG. 4. The runners 174 can be attached to the platform 170 such as by welding or molding or by any other method known in the art. The runners 174 serve to elevate the subcontainers 172 above the surface of the storage platform 170. Thus, the runners 174 serve to better enable sales personnel to insert the subcontainers 172 into and to remove the subcontainers 172 from the lower container 102 through the access door 122.

A front elevation of one of the subcontainers 172 is shown in FIG. 4 and, in general, is rectangular in shape. As with the lower container 102, the subcontainers 172 are comprised of a mesh construction to enable the merchandise stored and displayed therein to be seen. The mesh construction can be either of the heavy duty aluminum wire mesh or high strength plastic mesh variety. The subcontainers 172, as shown in FIG. 5, are open at the top end thereof. However, it is foreseen that one or more of the subcontainers 172 can include a lid or cover fashioned from the same mesh construction herein employed.

Each of the subcontainers 172 includes a pair of heavy duty tabs 176 extending out from the body of the mesh construction. The extension tabs 176 serve to distribute the weight of the subcontainers 172 and the contents thereof over a pair of the runners 174 as shown in FIG. 4. When installing or removing subcontainers 172 through the access door 122 of the lower container 102, the extension tabs 176 are aligned with and positioned above the pair of runners 174. The subcontainers 172 are then slid into or out of the lower container 102 on the runners 174. Since the subcontainers 172 are positioned on the runners 174 and elevated over the storage platform 170, any breakage or spillage of merchandise can be contained by the platform 170.

Each of the subcontainers 172 can be compartmentalized as is shown in FIG. 5 where eight subcontainers 172 are arranged within the upright sidewalls 110, 112, 114 and 116 of the lower container 102. A plurality of compartments 178 can be formed by utilizing the mesh construction within any particular subcontainer 172. The mesh construction within the individual subcontainers 172 functions as a plurality of dividers and the various compartments 178 serve to accommodate merchandise of different sizes. The extension tabs 176 and the storage platform 170 are visibly exposed between the subcontainers 172 as shown in FIG. 5.

During use of the invention, the multi-tier storage apparatus 100 can be positioned directly on the floor in the sales environment if so desired. Merchandise can be loaded into or removed from the lower container 102 through the access door 122 when the upper containers 104 and 106 are positioned on the horizontal projections 118 and 120. The height of the merchandise loaded into the lower container 102 must be less than the distance between the bottom surface 108 of the lower container 102 and the bottom surface 142 of the upper containers 104 and 106. If the storage platform 170 is utilized, then the merchandise is stored and displayed in the subcontainers 172 which are then positioned onto the runners 174. When the upper containers 104 and 106 are removed from the horizontal projections 118 and 120, merchandise can be stored and displayed in the lower container 102 directly from the open top as shown in FIG. 2.

Merchandise can be stored and displayed in and removed from the upper containers 104 and 106 directly from the open tops thereof as shown in FIGS. 1 and 2. Likewise, a consumer can inspect and remove merchandise from the lower container 102 by moving the upper containers 104 and 106 with respect to one another and with respect to the lower container 102. The consumer can then reach down into the lower container 102 and grasp the article for removal from the storage apparatus 100. After the merchandise has been removed, the access door 122 can be unlocked for restocking the lower container 102.

The present invention provides novel advantages over other storage devices known in the art. Initially, merchandise placed within the multi-tier storage apparatus 100 is positioned within the mesh construction of the lower and upper containers 102, 104 and 106, respectively, and thus is less likely to be displaced during an earthquake. Further, when merchandise is stored and displayed in the compartments 178 of the subcontainers 172 as shown in FIGS. 4 and 5, it is protected to even a higher degree. The merchandise is further protected in that the storage apparatus 100 exhibits a wide base and a low center of gravity which improves the overall stability. These features reduce the probability that the storage apparatus 100 will capsize during an earthquake.

Additionally, the multi-tier design of the storage apparatus 100 provides substantially greater storage space when compared to conventional single-tier containers. The multi-tier storage apparatus 100 can be located within a sales environment wherein both the upper containers 104 and 106 and the lower container 102 are accessible to customers. However, the access door 122 is normally locked and accessible only to sales personnel for stocking of merchandise. Further, the multi-tier storage apparatus 100 can easily be transported from one location to another in the unloaded condition for cleaning and restocking of merchandise. In the alternative, the storage apparatus 100 can be transported in the fully loaded condition by utilizing pallets and commercial lifting equipment normally found in supermarkets.

Additional features of the multi-tier storage apparatus 100 that are not illustrated in the drawing figures but nevertheless are within the spirit and scope of the invention include the following. The stability of the storage apparatus 100 can be further improved by attaching, as by welding or bonding, metal plates or pads to the underneath of the lower container 102. The metal plates or pads are intended to accommodate Velcro strips for attachment to mating Velcro strips attached to the floor or carpet. The stability and protection of the merchandise within the multi-tier storage apparatus 100 can be further improved if the plurality of wheels 152 attached to the upper containers 104 and 106 are lockable. Furthermore, the transportability of the storage apparatus 100 can be improved by adding handlebars at each end of the lower container 102. Accessibility to the lower container 102 through the access door 122 can be improved by incorporating a hook or latch device that will maintain the access door 122 open during restocking of merchandise. Likewise, the hook or latch device is simple to release when restocking is complete or when customers are present. Finally, in order to improve the appearance of the storage apparatus 100 when elegant or trendy merchandise is to be displayed, high quality plexiglas can be utilized in lieu of the wire or plastic mesh construction.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A multi-tier storage apparatus comprising:

first container means having a plurality of upright walls and a bottom surface each including a mesh construction, said first container means for storing and displaying merchandise;

horizontal projection means extending into said first container means from said upright walls; and multiple second container means mounted on said horizontal projection means for storing and displaying merchandise, each of said second container means having a mesh construction and being movable relative to other of said second container means and to said first container means along said horizontal projection means for accessing said first container means.

2. The storage apparatus of claim 1 wherein said first container means and each of said second container means is rectangular in shape and comprises a wire mesh construction.

3. The storage apparatus of claim 1 wherein said first container means and each of said second container means is rectangular in shape and comprises a plastic mesh construction.

4. The storage apparatus of claim 1 wherein said horizontal projection means comprises a ledge for supporting each of said second container means.

5. The storage apparatus of claim 1 wherein each of said second container means comprises a plurality of wheels for mounting on said horizontal projection means.

6. The storage apparatus of claim 5 wherein said plurality of wheels are comprised of plastic.

7. The storage apparatus of claim 5 wherein said plurality of wheels are comprised of rubber.

8. The storage apparatus of claim 1 wherein said first container means comprises a hinged door for providing access to said first container means.

9. The storage apparatus of claim 8 wherein said hinged door is lockable.

10. A multi-tier storage apparatus comprising:

first container means having a plurality of upright walls and a bottom surface each including a mesh construction, said first container means for storing and displaying merchandise;

horizontal projection means extending into said first container means from said upright walls; and multiple second container means each having a plurality of wheels for mounting on said horizontal projection means, each of said second container means having a mesh construction for storing and displaying merchandise and being movable relative to other of said second container means and to said first container means along said horizontal projection means for accessing said first container means.

11. A multi-tier storage apparatus comprising:

first container means having a plurality of upright walls and a bottom surface each including a mesh construction;

platform means mounted on top of said bottom surface of said first container means for supporting a plurality of subcontainers for storing and displaying merchandise;

horizontal projection means extending into said first container means from said upright walls; and multiple second container means mounted on said horizontal projection means for storing and displaying merchandise, each of said second container means having a mesh construction and being movable relative to other of said second container means and to said first container means along said horizontal projection means for accessing said first container means.

12. The storage apparatus of claim 11 wherein said platform means comprises a plurality of runners for directly supporting said plurality of subcontainers.

13. The storage apparatus of claim 12 wherein each of said subcontainers includes a pair of extension tabs for seating on a corresponding pair of said runners.

14. The storage apparatus of claim 11 wherein each of said subcontainers is compartmentalized.

15. The storage apparatus of claim 11 wherein each of said subcontainers is comprised of a wire mesh construction.

16. The storage apparatus of claim 11 wherein each of said subcontainers is comprised of a plastic mesh construction.

17. The storage apparatus of claim 11 wherein said platform means is comprised of metal.

18. The storage apparatus of claim 11 wherein said platform means is comprised of plastic.

* * * * *